US005299662A

United States Patent [19]

Reddy et al.

[11] Patent Number: 5,299,662

[45] Date of Patent: Apr. 5, 1994

[54] LINEAR MOTOR ELEVATOR HAVING HYBRID ROPING AND STATIONARY PRIMARY

[75] Inventors: K. Narasimha Reddy, Bolton; John K. Salmon, South Windsor, both of Conn.

[73] Assignee: Otis Elevator Company, Farmington, Conn.

[21] Appl. No.: 995,220

[22] Filed: Dec. 22, 1992

Related U.S. Application Data

[63] Continuation-in-part of Ser. No. 919,440, Jul. 27, 1992.

[51] Int. Cl.[5] ..... B66B 17/12

[52] U.S. Cl. ..... 187/94; 187/112; 310/13

[58] Field of Search ..... 187/1 R, 94, 112; 310/12, 13

[56] References Cited

U.S. PATENT DOCUMENTS

| | | | |
|---|---|---|---|
| 1,277,567 | 9/1918 | Garrison | 187/195 |
| 3,101,130 | 8/1963 | Bianca | 187/20 |
| 3,211,259 | 10/1965 | Tofanelli | 187/95 |
| 4,402,386 | 9/1983 | Ficheux et al. | 187/29 R |
| 4,570,753 | 2/1986 | Ohta et al. | 187/1 R |
| 4,949,815 | 8/1990 | Pavoz | 187/20 |
| 5,005,672 | 4/1991 | Nakai et al. | 187/17 |
| 5,014,826 | 5/1991 | Nakai et al. | 187/112 |
| 5,033,588 | 7/1991 | Nakai et al. | 187/95 |
| 5,036,954 | 8/1991 | Haahtikivi et al. | 187/95 |
| 5,062,501 | 11/1991 | Pavoz et al. | 187/112 |
| 5,074,384 | 12/1991 | Nakai et al. | 187/94 |
| 5,090,516 | 2/1992 | Grinaski et al. | 187/112 |
| 5,127,493 | 7/1992 | Yasuda et al. | 187/94 |

FOREIGN PATENT DOCUMENTS

| | | | |
|---|---|---|---|
| 92052533 | 7/1992 | Fed. Rep. of Germany . | |
| 2-310279 | 12/1990 | Japan . | |
| 3-143891 | 6/1991 | Japan . | |
| 4-3791 | 1/1992 | Japan . | |
| 4-39286 | 2/1992 | Japan | 187/112 |
| 4-39286 | 2/1992 | Japan . | |
| 4-101980 | 4/1992 | Japan | 187/112 |
| 101980 | 4/1992 | Japan . | |
| 2237555A | 5/1991 | United Kingdom . | |

OTHER PUBLICATIONS

"Linear Electric Machines—A Personal View;" *Proceedings of the IEEE*, vol. 63, No. 2, pp. 250–289; Feb. 1975; Author: E. R. Laithwaite.

"Applying Linear Motors in Material Handling;" *Machine Design*, pp. 91–96, Jan. 26, 1989; Author: Ian Blease et al.

"Linear Electric Machines," *Handbook of Electric Machines*, pp. 7–1 through 7–41; Authors: I. Boldea, S. A. Nasar.

"Vertical Transportation;" *Elevators and Escalators*, Second Edition, pp. 9–12; (1983 John Wiley & Sons); Author: G. R. Strakosch.

"Getting a Lift from Linear Motors;" *Popular Science*, p. 25, Feb. 1991.

"Special AC Motors and their Applications in Industry;" pp. 52–54; Author: Alfred Berutti.

*Primary Examiner*—D. Glenn Dayoan
*Assistant Examiner*—Kenneth Noland
*Attorney, Agent, or Firm*—Joseph P. Abate

[57] ABSTRACT

A linear motor elevator system includes a car mechanically coupled to a counterweight assembly such that the car roping ratio is less than the counterweight assembly roping ratio. A primary element of the linear motor is disposed on or within a hoistway wall associated with the secondary element of the linear motor. Alternatively, the primary element is affixed to a support frame of the elevator system. The counterweight assembly includes the motor secondary. The elevator system of the present invention reduces the volume within the hoistway interior occupied by the primary and secondary members of the linear motor.

22 Claims, 6 Drawing Sheets fig.5
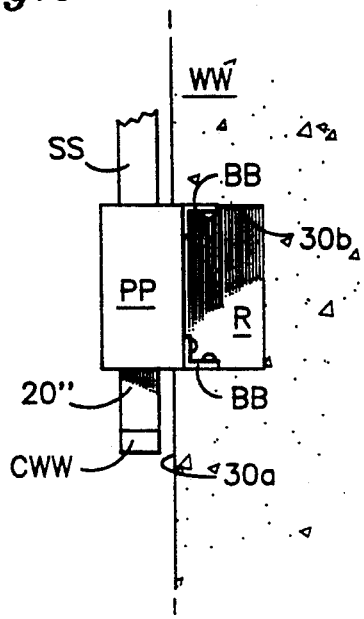
fig.5A
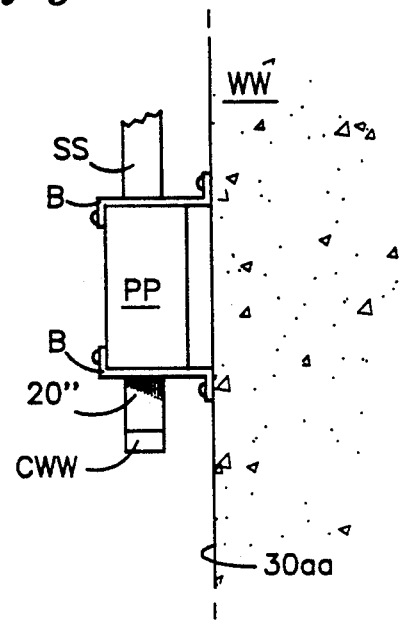
fig.6A
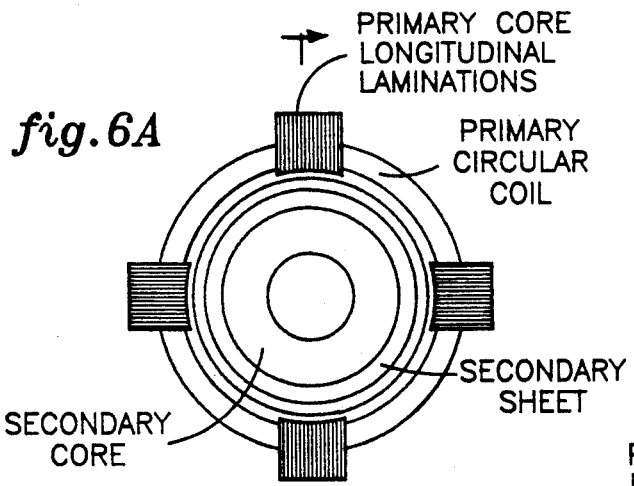
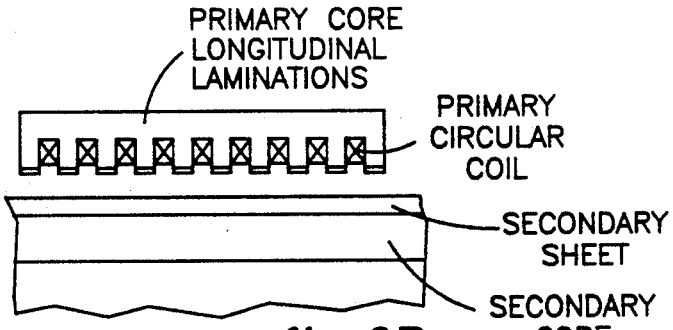
fig.6B
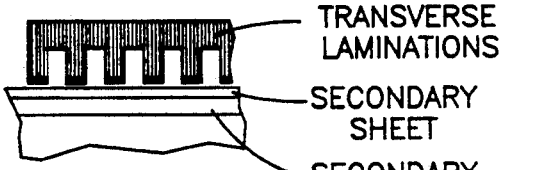
fig.6C

LINEAR MOTOR ELEVATOR HAVING HYBRID ROPING AND STATIONARY PRIMARY

CROSS-REFERENCE TO RELATED APPLICATIONS

This application is a continuation-in-part of commonly-owned U.S. patent application Ser. No. 07/919,440, filed Jul. 27, 1992, entitled "Linear Motor Elevator System having Hybrid Roping Arrangement and Stationary Primary," by Reddy et al.

BACKGROUND OF THE INVENTION

I. Field of the Invention

The present invention relates to elevator systems and, more particularly, to linear motor driven elevator systems.

II. Description of Related Art

Linear motor driven elevator systems are known. See, for example, U.S. Pat. Nos.: 4,402,386; 5,005,672; 5,033,588; 5,062,501 and 5,074,384. Such systems include a plurality of walls forming a hoistway associated with a number of substantially vertical guide rails on which are slidably mounted an elevator car and a counterweight assembly. The counterweight assembly includes a primary element of a linear motor and counterweights, all suitably mounted within a movable frame. A secondary element of the linear motor is located within the interior of the hoistway. The secondary extends a vertical distance (i.e., has a height dimension) substantially equal to a maximum height of the hoistway. A roping arrangement mechanically connects the car to the counterweight assembly so that a total travel distance of the car in one direction equals a total travel distance of the counterweight assembly in an opposite direction. The primary receives electrical energy from an AC source through a traveling power cable and interacts electromagnetically with the secondary to move the counter-weight assembly in vertical (up and down) directions along the guide rails.

U.S. Pat. No. 4,570,753 teaches a linear motor elevator having a stationary primary affixed to a hoistway wall and also having a flexible secondary affixed to a counterweight assembly. A total travel distance of the car equals a total travel distance of the secondary.

In order to use building space efficiently and economically, elevator system designers strive to reduce the volume within the interior of the hoistway required by the elevator system. U.S. Pat. No. 5,036,954 teaches a traction elevator system having hybrid roping in which a car roping ratio is less than a counterweight assembly roping ratio. Thus, the distance traveled by the counterweight assembly is shorter than the distance traveled by the elevator car during normal operation of the elevator system. The volume within the interior of the hoistway required by the counterweight assembly during normal operation of the traction elevator system is reduced.

The known systems have proven to be not entirely satisfactory because they continue to occupy a large volume of building space. The present inventors have achieved reductions in the volume occupied by a linear motor elevator system.

SUMMARY OF THE INVENTION

It is the principal object of the present invention to reduce the volume within the interior of the hoistway required by members of a linear motor elevator system.

It is an additional object of the present invention to decrease the height dimension of the secondary in a linear motor elevator system.

It is a further object of the present invention to reduce the total travel distance of the counterweight assembly in a linear motor elevator system.

It is another object of the present invention to mount a motor primary reliably with respect to a motor secondary in a linear motor elevator system having hybrid roping.

According to the invention, an elevator system includes a linear motor and a hybrid roping arrangement. The hybrid roping arrangement is configured such that a car roping ratio is less than a counterweight assembly roping ratio. Preferably, at least a portion of the motor primary is disposed in a recess formed in a hoistway wall associated with the linear motor. The entire primary of a single-sided flat linear motor may be affixed within the recess. Optionally, the invention includes a platform or other support member on which the motor primary is mounted. A counterweight assembly includes a secondary of the linear motor. Alternatively, the invention employs a tubular linear motor.

The elevator system of the present invention reduces the volume within the interior of the hoistway required by the linear motor. The height dimension of the secondary is substantially less than the maximum height of the hoistway. The total travel distance of the counterweight assembly is substantially less than that of the car. Further, the invention permits a simple electrical connection between the primary and the electrical energy source and eliminates a traveling power cable.

Further and still other objects of the present invention will become more readily apparent in light of the following detailed description when taken in conjunction with the accompanying drawing, in which:

BRIEF DESCRIPTION OF THE DRAWING

FIG. 5 and FIG. 5A are partial side schematic views of a counterweight assembly, a secondary (partly broken away) and a motor primary with alternative mounting arrangements for embodiments employing tubular linear motors;

FIG. 6A, FIG. 6B and FIG. 6C show top and side schematic views of a motor primary surrounding a motor secondary for embodiments employing tubular linear motors;

DESCRIPTION OF THE PREFERRED EMBODIMENTS

Figure 1:
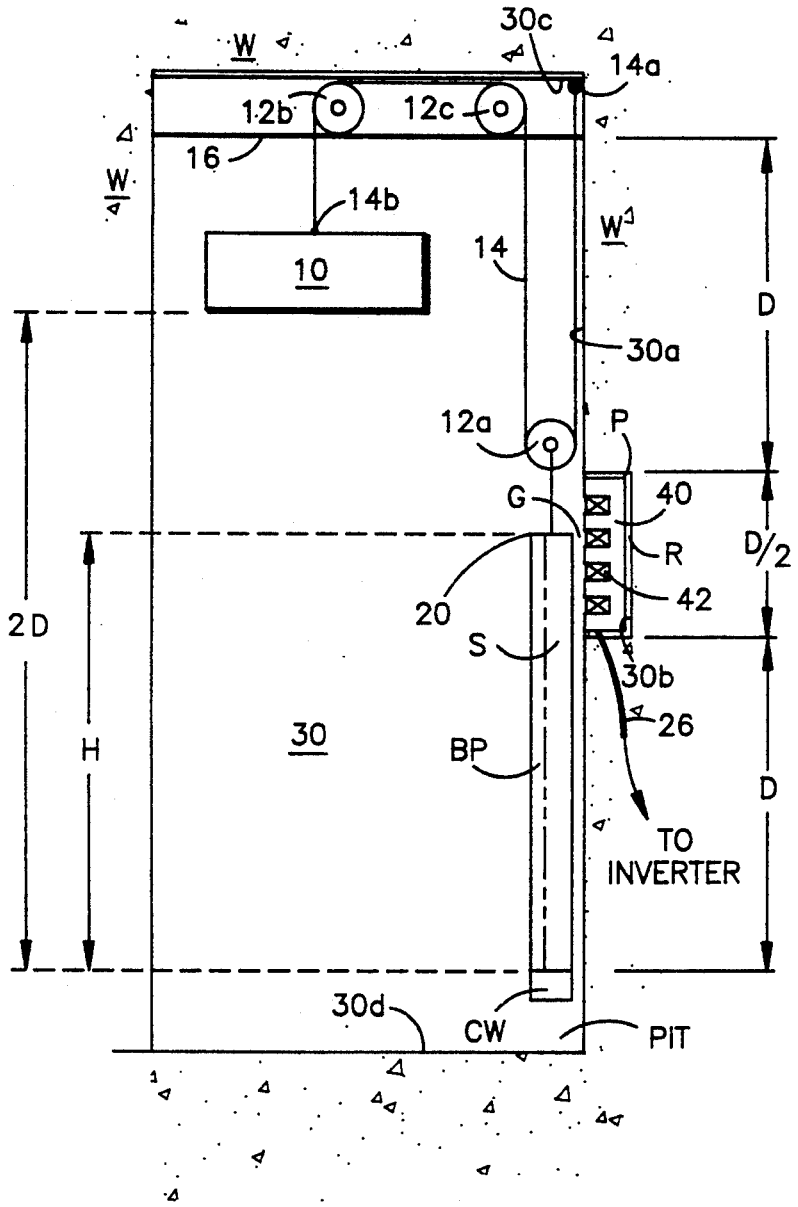
FIG. 1 is a side schematic view of an elevator system with a flat single-sided linear motor and hybrid roping according to the present invention.

FIG. 1 shows an elevator system according to the present invention. A car 10 is mechanically coupled to a counterweight assembly 20 by means of a hybrid roping arrangement 12*a*, 12*b*, 12*c*, 14. The hybrid roping arrangement includes pulleys 12*a*, 12*b*, 12*c* and a suspension rope 14. One end 14*a* of the rope 14 is suitably affixed (e.g., anchored by means of a bolt or hitch not shown) to a top or ceiling wall W through a wall surface 30*c* of a hoistway or elevator shaft 30 (discussed below). The other end 14*b* of the rope 14 is suitably affixed to the car 10. The pulley 12*a* is attached to the counterweight assembly 20 by any conventional means. The pulleys 12*b*, 12*c* are suitably rotatably mounted on a cross member 16 anchored in known fashion to, for example, side walls W. The rope 14 passes around the pulleys 12*a*, 12*b*, 12*c* such that the car roping ratio is less than the counterweight assembly roping ratio. Preferably, the car roping ratio is 1:1 while the counterweight assembly roping ratio is 2:1. However, other hybrid roping ratios are within the scope of the invention provided that the roping ratio of the car is less than the roping ratio of the counterweight assembly. In normal operation, the car 10 travels a total distance 2D (shown between dashed lines) while the counterweight assembly 20 travels a total distance D.

A linear motor (e.g., flat single-sided) includes a primary P spaced from a secondary S (e.g., parallelepiped-shaped) by a substantially constant air gap G. The counterweight assembly 20 includes the secondary S and a counterweight CW suitably attached (e.g., affixed) to the secondary. Desirably, the secondary S has a height dimension (H) in a range between 1.1D and 1.5D. The secondary S is rigid and is formed of any suitable electrical conductor such as copper or aluminum. The secondary S may include a suitable back plate BP of a magnetic material (e.g., iron) for efficiently returning magnetic flux to the primary. The weight of the counterweight assembly 20 is preferably approximately two times (empty weight of the car 10 plus 40% to 50% of the car duty load).

As previously mentioned, a plurality of walls W (e.g., concrete, brick, etc.) forming a part of a building is associated with the car, the hybrid roping arrangement and the counterweight assembly. The walls W form the hoistway 30 having a maximum height of approximately 2.5D (not including the height of the pit). One of the walls W has a surface 30*a* facing the interior of the hoistway 30 and, preferably, has a surface 30*b* forming a cavity or recess R which opens in a direction generally toward the interior of the hoistway 30. In FIG. 1, the entire motor primary P is disposed in the recess R. Brackets (not shown) or other suitable means for fixing the primary in the recess can be used. Desirably, the dimensions of the recess are slightly larger than the outer dimensions of the primary P. The recess, the primary and the secondary are located and dimensioned such that the primary suitably interacts electromagnetically with the secondary S to thrust the counterweight assembly 20 vertically during normal operation of the elevator system. In FIG. 1, a center of the primary surface facing the interior of the hoistway is located at a distance approximately 1.25D vertically up the hoistway wall surface 30*a*. A total height dimension of the primary may be in a range between approximately 0.1D and approximately 0.5D.

Figure 2:
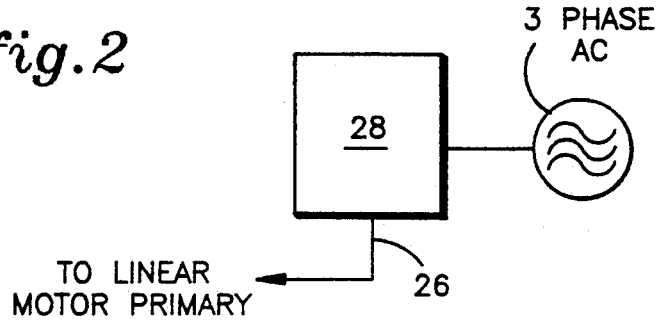
FIG. 2 is a schematic view of an inverter and an AC power source for the linear motor of FIG. 1.

The motor primary P includes a core of magnetic material and windings of electrically conductive material associated with the core. FIG. 1 shows a core of, for example, slotted steel laminations 40 and a number of slot-embedded windings 42. The windings 42 are electrically connected to an inverter 28 (FIG. 2) by means of a three-phase AC power cable 26. Preferably, substantially the entire primary P is disposed within the recess R. However, depending on the particular type of linear motor utilized in the instant invention, a part of the primary P may extend beyond the wall surface 30*a*. FIG. 5 shows a tubular linear motor having a tubular primary PP forming a channel therethrough. The primary PP surrounds a tubular secondary SS slidably disposed in the channel and suitably spaced by an air gap (e.g., FIG. 6A, FIG 6B and FIG. 6C) from the primary PP. The secondary is attached to a counterweight CWW. The primary is only partially disposed in the recess R so that the secondary may travel vertically through the primary. Brackets BB fix the primary PP to the wall surface 30*b*. Disposing at least a portion of the motor primary P, PP within a wall recess R removes that portion of the primary from any interference with the motion of the counterweight assembly 20, 20″ during normal operation of the elevator system.

Figure 7:
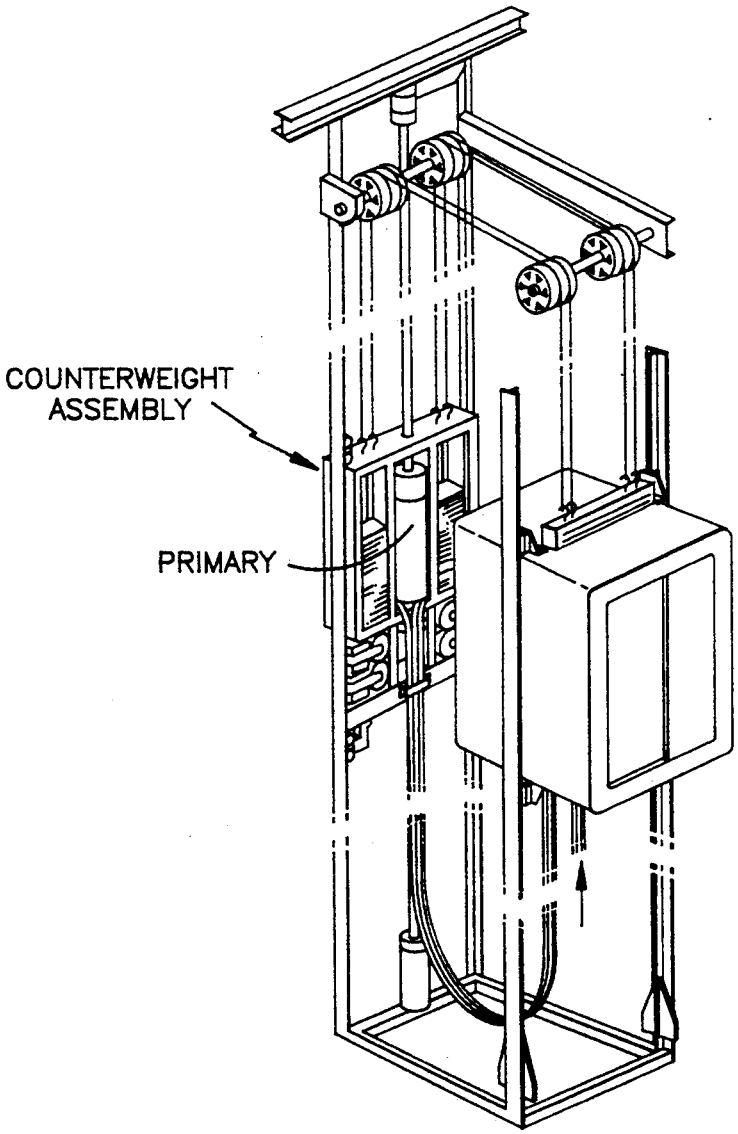
fig. 7 prior art
FIG. 7 is a front and side perspective view of a tubular linear motor elevator system with a movable primary according to the prior art.

The car 10 and the counterweight assembly 20, 20″ are slidably mounted with known means on respective guide rails (not shown) to permit guided motion up and down the hoistway 30. The guide rails for the counterweight assembly 20, 20″ also permit the motor secondary S, SS to maintain a substantially constant air gap G between the secondary S, SS and the primary P, PP. Optionally, the counterweight assembly 20, 20″ can employ rollers or slide members (both not shown), and/or the guide rails, for maintaining the air gap substantially constant. Various guide rail, roller, slide member and pulley arrangements are known generally in the art. See, for example, U.S. Pat. Nos.: 4,949,815; 5,005,672; 5,014,826 and 5,033,588 which are hereby incorporated by reference; see also the known linear motor elevator of FIG. 7.

Figure 8:
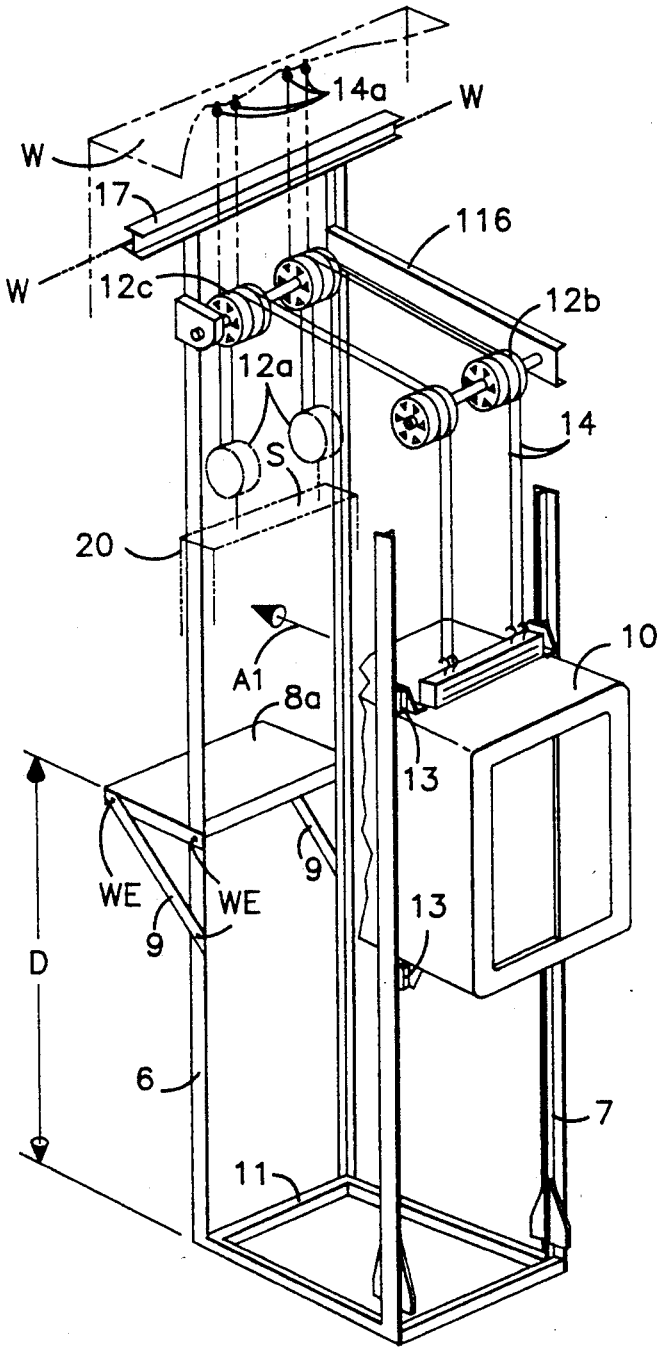
FIG. 8 is a front and side perspective view, partly in section and broken away, of a still further alternative arrangement for mounting a motor primary, the arrangement including a platform attached to a support frame for a car, linear motor and a hybrid roping arrangement.
Figure 9:
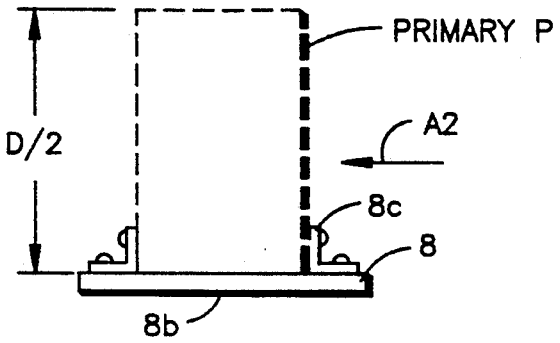
FIG. 9 is a front plan view of a motor primary mounted on a platform of a support frame in the direction of an arrow A1.
Figure 10:
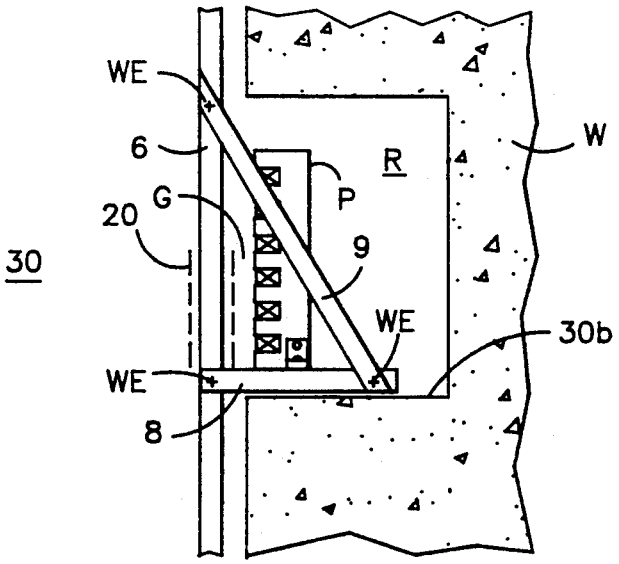
FIG. 10 is a side sectional view of a primary disposed within a wall recess, and of portions of a support frame and a counterweight assembly (in phantom) in the direction of an arrow A2.

FIGS. 8, 9, 10 show a still further alternative arrangement for mounting a motor primary, (e.g., P, P′, PP) reliably with respect to a motor secondary (e.g., S, S′, SS). In FIGS. 8, 9, 10 and 1, like reference numerals and letters designate like elements. FIG. 8 shows one type of a support frame 6, 7, 11, 116, 17 for a car 10, a counterweight assembly 20 and a hybrid roping arrangement 12*a*, 12*b*, 12*c*, 14. A lower support portion 11 (e.g., of steel) is affixed to vertical guide rails 7 for the car 10 and also to vertical guide rails 6 for the assembly 20. The rails are, e.g., steel "T"-shaped rails. The car 10 includes slide members 13 while the assembly 20 includes identical slide members (not shown). As shown in FIG. 8, the elevator system of the invention may include pairs of pulleys 12*a* (shown in phantom), 12*b*, 12*c* associated with the rope 14 which is connected to the car 10 and to a ceiling W so that hybrid roping is realized. A cross member 17 (e.g., steel) is anchored to one pair of hoistway walls W, while a cross member 116 (e.g., steel) may be optionally anchored to another pair of walls W (not shown). As is understood by those skilled in the art in view of this disclosure, the combination of the support frame connected to the building walls W provides all structural support necessary for the car 10, assembly 20 and the roping arrangement 12*a*, 12*b*, 12*c*, 14. The lower support portion 11 rests on a bottom surface 30*d* of the pit (FIG. 1).

According to the further alternative mounting arrangement of the present invention, a primary P, P', PP is attached (e.g., affixed) to the support frame. Preferably, the support frame includes a rigid platform 8 (e.g., steel) attached (e.g., affixed) to the rails 6 by means of braces 9 (e.g., steel) and, e.g., welds WE. The primary (e.g., P) is affixed to a platform top surface 8*a* by means of brackets (e.g., metal) 8*c*. FIG. 9 shows the primary P in phantom in the direction of an arrow A1; the assembly 20 and remainder of the frame are not shown for clarity. FIG. 10 shows the primary P in the direction of an arrow A2 and disposed within the recess R. The primary P is affixed to the platform 8, which is affixed to the rails 6 by means of an optional arrangement of the braces 9. The platform bottom surface 8*b* faces the wall surface 30*b*. Of course, the platform 8 may optionally rest upon the wall surface 30*b* or may be optionally connected to other parts of the wall W.

Buffers (not shown) are disposed at the bottom surface 30*d* of the pit to absorb the downward force of the car and/or the counterweight assembly 20, 20', 20'' in the event of cable 14 breakage.

Figure 4A:
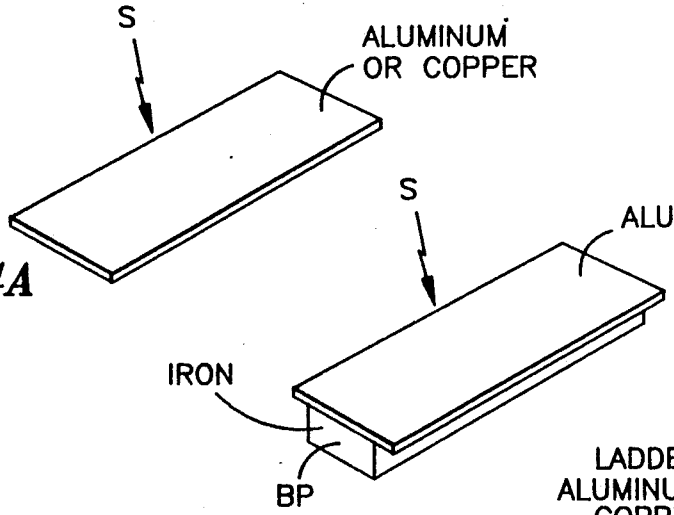
FIG. 4A, FIG. 4B and FIG. 4C show front and side perspective views of various secondaries for the motors of FIGS. 1 and 3.
Figure 4B:
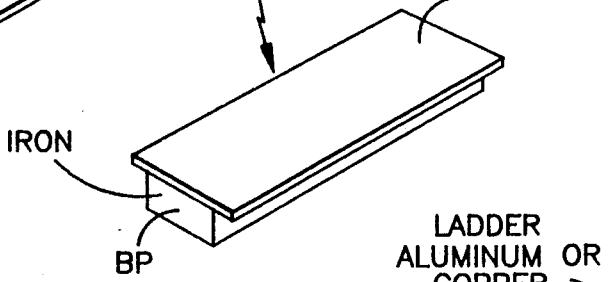
Figure 4C:
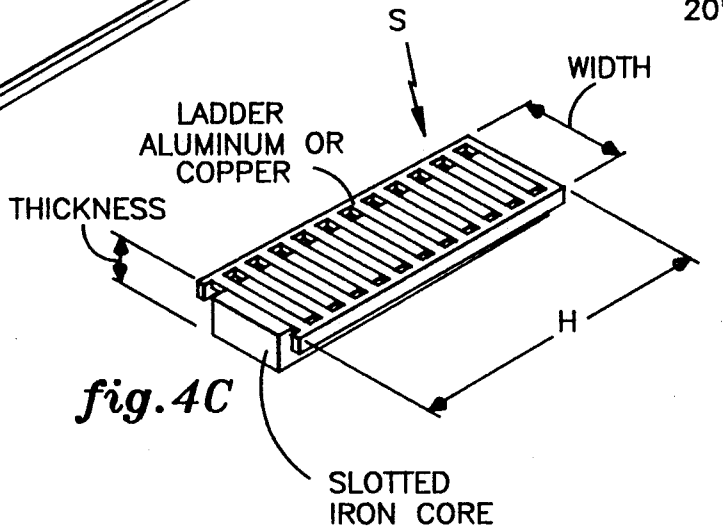

FIG. 4A, FIG. 4B and FIG. 4C show three embodiments of the motor secondary S. In one preferred embodiment, useful in the system of FIG. 1, the secondary S includes an aluminum or copper sheet affixed to an iron back plate BP. In FIG. 5 and FIG. 6A, FIG. 6B and FIG. 6C the secondary SS includes, for example, a cylindrical core of iron intimately surrounded by a sleeve (or sheet) of aluminum or copper. Specific dimensions and materials for the various secondaries and primaries for the present invention are well within the skill of the art in view of the instant specification.

Various types of linear motors can be utilized in the present invention. For example, linear induction or linear synchronous motors which are flat, tubular, single or double-sided may be utilized. See, for example, the book *Linear Electric Motors: Theory, Design, and Practical Applications* by S. A. Nasar and I. Boldea (1987, Prentice-Hall, Inc.)—Chapters 1 through 5 inclusive which are hereby incorporated by reference.

Figure 3:
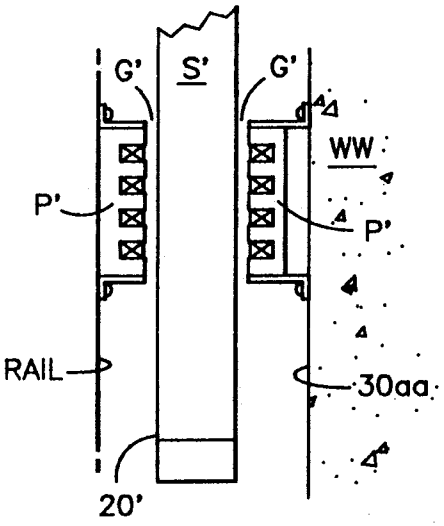
FIG. 3 is a partial side schematic view of a counterweight assembly and a primary for a flat double-sided linear motor elevator system of the present invention.

Finally, some benefits of the present invention can be achieved without disposing any portion of a primary within a hoistway wall recess, provided that a hybrid roping arrangement couples the secondary to the car. In this embodiment, the motor primary is affixed to the wall surface. See, for example, the tubular linear motor primary PP affixed to a hoistway wall surface 30*aa* by brackets B in FIG. 5A. Also, see the flat double-sided linear motor primary having two core parts P' spaced from a secondary S' by an air gap G' in FIG. 3. One core part P' is affixed to the wall surface 30*aa* while the other core part is affixed to a stationary rail anchored to the hoistway.

While there has been shown and described what is at present considered to be preferred embodiments of the present invention, various changes and modifications may be made therein without departing from the spirit and scope of the invention which shall be limited only by the appended claims.

For example, a support frame can be constructed as a stand-alone frame to support the car, counterweight assembly, the hybrid roping arrangement and the motor primary. Such a frame is particularly useful when the hoistway 30 is determined primarily by the support frame rather than the walls W. The side surfaces (e.g., 30*a*) may be located a distance too remote from the rails (e.g., 6) so that the primary cannot be disposed usefully within a recess R.

Figure 11:
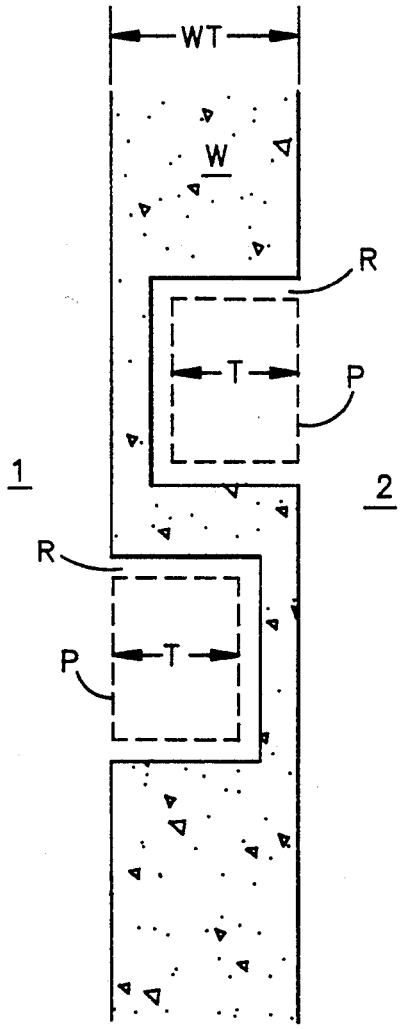
FIG. 11 is a side sectional view of two immediately adjacent hoistways 1, 2 each having a respective motor primary disposed within a respective recess.

In addition, immediately adjacent hoistways can utilize the invention. In such event, a wall thickness WT of a wall W separating adjacent hoistways 1, 2 can be less than the sum of the thicknesses T of the primaries P; see FIG. 11.

What is claimed is:

1. An elevator system, comprising:

a car;

a counterweight assembly including a motor secondary;

a roping arrangement coupling said car to said counterweight assembly, said roping arrangement determining a car roping ratio and a counterweight assembly roping ratio, said car roping ratio being less than said counterweight assembly roping ratio so that a total travel distance of said counterweight assembly is less than a total travel distance of said car during normal operation of the elevator system;

guide rails, said counterweight assembly being mounted on said guide rails;

a platform for a motor primary, said platform being attached to said guide rails;

at least one wall associated with said counterweight assembly, said wall forming a recess which opens in a direction generally towards said counterweight assembly; and a motor primary mounted on said platform, at least portions of said platform and said motor primary being disposed in said recess, said motor secondary being spaced from said motor primary by a substantially constant air gap.

2. An elevator system as claimed in claim 1, wherein all of said motor primary is disposed within said recess.

3. An elevator system as claimed in claim 2, wherein said motor secondary includes a sheet of an electrically conductive material.

4. An elevator system as claimed in claim 3, wherein said electrically conductive material is aluminum.

5. An elevator system as set forth in claim 3, wherein said electrically conductive material is copper.

6. An elevator system as claimed in claim 3, wherein said motor secondary further includes a back plate of a magnetic material attached to said sheet.

7. An elevator system as claimed in claim 1, wherein said car roping ratio is 1:1 and said counterweight assembly roping ratio is 2:1.

8. An elevator system as claimed in claim 1, wherein said motor primary is fixed on said platform.

9. An elevator system is claimed in claim 1, wherein said platform is affixed to said guide rails.

10. An elevator system as claimed in claim 1, wherein said counterweight assembly consists essentially of said motor secondary.

11. An elevator system as claimed in claim 1, wherein said motor secondary has a height (H) which is greater than said total travel distance of said counterweight assembly and less than said total travel distance of said car.

12. An elevator system as claimed in claim 11, wherein said height of said motor secondary is a height within a range between 1.1D and 1.5D, and wherein D equals said total travel distance of said counterweight assembly.

13. An elevator system as claimed in claim 11, wherein said height (H) of said motor secondary is greater than D and less than 1.5D, and wherein D equals said total travel distance of said counterweight assembly.

14. An elevator system as claimed in claim 11, wherein said motor primary includes a parallelepiped-shaped core part having a plurality of slots and a number of electrical windings located within said slots.

15. An elevator system, comprising:

a car;

a counterweight assembly including a motor secondary;

a roping arrangement coupling said car to said counterweight assembly, said roping arrangement determining a car roping ratio and a counterweight assembly roping ratio, said car roping ratio being less than said counterweight assembly roping ratio so that a total travel distance of said counterweight assembly is less than a total travel distance of said car during normal operation of the elevator system;

substantially vertical guide rails, said car, said counterweight assembly and said roping arrangement being mounted on said guide rails; and a motor primary fixed to and at least partially supported by at least two of said guide rails, said motor secondary being spaced from said motor primary by a substantially constant air gap.

16. An elevator system as claimed in claim 15, further comprising a platform on which said motor primary is fixed, said platform being fixed to said at least two guide rails.

17. An elevator system as claimed in claim 15, further comprising building walls which form a hoistway having a recess, said car, said counterweight assembly, said roping arrangement and said vertical guide rails being located within said hoistway, said motor primary being disposed within said recess, and said substantially vertical guide rails being connected to said building walls.

18. An elevator system, comprising:

a car;

a linear motor having a primary and a secondary;

a hybrid roping arrangement coupling said car to said secondary; and a frame, said car, said linear motor and said hybrid roping arrangement being mounted on said frame, and said primary being fixed to and being at least partially supported by said frame.

19. An elevator system as claimed in claim 18, wherein said frame includes a platform and at least a pair of guide rails, said platform being fixed to said guide rails, said primary being fixed to said platform.

20. An elevator system as claimed in claim 18, further comprising building walls forming a hoistway, said frame being located within said hoistway and being connected to said building walls.

21. An arrangement, comprising:

a wall which forms a first recess opening in a first direction and which forms a second recess opening in a second direction, said first direction being generally opposite said second direction;

a first core of a magnetic material having first windings of an electrically conductive material disposed therein;

a second core of a magnetic material having second windings of an electrically conductive material disposed therein;

said first core and first windings being disposed within said first recess, said second core and second windings being disposed within said second recess.

22. An arrangement as claimed in claim 21, wherein said wall has a wall thickness, said first core has a first thickness, and said second core has a second thickness, and wherein said wall thickness is less than a sum of said first thickness and said second thickness.

* * * * *